US007651604B2

(12) United States Patent
Ancheyta Juárez et al.

(10) Patent No.: US 7,651,604 B2
(45) Date of Patent: Jan. 26, 2010

(54) PROCESS FOR THE CATALYTIC HYDROTREATMENT OF HEAVY HYDROCARBONS OF PETROLEUM

(75) Inventors: Jorge Ancheyta Juárez, Eje Central Norte Lázaro Cárdenas (MX); Gerardo Betancourt Rivera, Eje Central Norte Lázaro Cárdenas (MX); Gustavo Jesús Marroquín Sánchez, Eje Central Norte Lázaro Cárdenas (MX); Guillermo Centeno Nolasco, Eje Central Norte Lázaro Cárdenas (MX); José Antonio Domingo Muñoz Moya, Eje Central Norte Lázaro Cárdenas (MX); Frenando Alonso Martínez, Eje Central Norte Lázaro Cárdenas (MX)

(73) Assignee: Instituto Mexicano del Petroleo, Mexico City (MX)

( * ) Notice: Subject to any disclaimer, the term of this patent is extended or adjusted under 35 U.S.C. 154(b) by 286 days.

(21) Appl. No.: 10/563,577

(22) PCT Filed: Jul. 9, 2003

(86) PCT No.: PCT/MX03/00053

§ 371 (c)(1),
(2), (4) Date: Jun. 21, 2006

(87) PCT Pub. No.: WO2005/005581

PCT Pub. Date: Jan. 20, 2005

(65) Prior Publication Data

US 2007/0187294 A1 Aug. 16, 2007

(51) Int. Cl.
*C10G 65/00* (2006.01)

(52) U.S. Cl. ..... 208/49; 208/58; 208/85; 208/177; 208/208 R; 208/209; 208/210; 208/213; 208/216 PP; 208/216 R; 208/217; 208/251 H; 208/251 R; 208/253; 208/264

(58) Field of Classification Search ..... 208/177, 208/208 R, 209–210, 213–215, 216 R, 251 H, 208/251 R, 253, 264, 49, 58, 85, 216 PP, 208/217

See application file for complete search history.

(56) References Cited

U.S. PATENT DOCUMENTS 3,901,792 A 8/1975 Wolk et al.

(Continued)

OTHER PUBLICATIONS

Trueba, M. et al. (2005). Gamma-alumina as a support for catalysts: a review of fundamental aspects. Eur. J. Inorg. Chem., pp. 3393-3403.*

(Continued)

*Primary Examiner*—Glenn A Caldarola
*Assistant Examiner*—Brian McCaig
(74) *Attorney, Agent, or Firm*—Roylance, Abrams, Berdo & Goodman, L.L.P.

(57) ABSTRACT

Two-stage low pressure catalytic hydrotreatment of heavy petroleum hydrocarbons having a high content of contaminants (metals and asphaltenes), is conducted under operating conditions with low-pressure, in a fixed bed or ebullated bed reactor to limit the formation of sediments and sludge in the product and obtain a hydrotreated hydrocarbon of improved properties, with levels of contaminants, API gravity and distillates within the ranges commonly reported in the feedstocks typical to refining schemes. A hydrotreatment catalyst, whose principal effect is the hydrodemetallization and the hydrocracking of asphaltenes of the heavy hydrocarbons of petroleum is used in the first stage, and the second reaction stage employs a hydrotreatment catalyst for a deeper effect of hydrodesulfurization of the heavy petroleum hydrocarbon whose content of total sulfur is reduced to a level required for its treatment in the conventional refining process or for its sale as a hydrocarbon of petroleum with improved properties.

22 Claims, 1 Drawing Sheet

U.S. PATENT DOCUMENTS

| | | | | | |
|---|---|---|---|---|---|
| 4,166,026 | A | | 8/1979 | Fukui et al. | |
| 4,619,759 | A | * | 10/1986 | Myers et al. | 208/210 |
| 4,657,664 | A | | 4/1987 | Evans et al. | |
| 5,591,325 | A | | 1/1997 | Higashi | |
| 5,779,992 | A | | 7/1998 | Higashi | |
| 5,925,238 | A | * | 7/1999 | Duddy et al. | 208/210 |

OTHER PUBLICATIONS

Williams, P.T. et al (2001). Fuel, 80, 957-963.*

Olguin, E. et al (1997). Applied Catalysis A: General, 165, 1-13.*

Ancheyta et al., "Hydroprocessing of Maya Heavy Crude Oil in Two Reaction Stages", Applied Catalysis A: General 233 (2002) 159-170, Jul. 10, 2002.

* cited by examiner

PROCESS FOR THE CATALYTIC HYDROTREATMENT OF HEAVY HYDROCARBONS OF PETROLEUM

TECHNICAL FIELD OF THE INVENTION

The present invention provides a process of the oil refining industry, in which a catalytic hydrotreatment of heavy hydrocarbons of petroleum is carried out in order to improve their properties.

BACKGROUND OF THE INVENTION

The evolution of the refining industry has lead to the hydrotreatment of heavy hydrocarbons of petroleum acquiring a technological and economic importance similar to the processes of hydrocracking and catalytic reforming. Among the heavy hydrocarbons of petroleum are the heavy crudes, the extra-heavy crudes, blends of heavy and light crudes and petroleum residuals, such as residues from the atmospheric or vacuum distillation, which present a specific gravity less than 32° API and a content of distillates recovered @ 538° C. less than 80% by volume.

The production of heavy crudes and the availability of petroleum residuals with high sulfur and metal contents, as well as the demands regarding the improvement of fuels in their ecological quality, brought about the development and expansion of hydrotreatment processes of this type of feedstocks for their refining.

Since the 70's, there have been reports of the hydrotreatment of petroleum residuals where they state the main aim as the recovery of valuable distillable fractions with low heavy heteroatom concentration.

The heavy crudes require a treatment similar to the petroleum residuals for their processing, due to the fact that they are characterized by their low Hydrogen/Carbon (H/C) ratio, high viscosity, high content of contaminants, essentially sulfur, nitrogen and metals, and low yield of distillates.

The reactive system is the part of the process where most attention has been placed for the treatment of this type of feedstocks, which may be fixed-bed, ebullated-bed or in dispersed phase. The refining industry mostly uses the fixed-bed type.

The high concentration of metals in heavy crudes and in petroleum residuals is reflected by a fast deactivation of the catalysts, therefore it is important that these feedstocks be demetallized in a first stage of their treatment to maximize the removal of other contaminants in later stages, thereby increasing the lifecycle of the catalysts used in these stages.

The most efficient refining processes in the removal of contaminants are those of hydrotreatment, which are applied to practically all fractions of oil such as: naphthas, middle distillates, vacuum distillates, residues, etc. In the case of heavy crudes and petroleum residuals, where the desire is to simultaneously remove various contaminants, principally: metals, sulfur, nitrogen and asphaltenes; it requires an appropriate selection of the type of reactor, catalysts with high activity and selectivity for these reactions, as well as operating conditions that will render the process profitable.

The improvement of a heavy hydrocarbon of petroleum implies its processing to remove contaminants and increase the Hydrogen/Carbon (H/C) ratio, usually by the use of process schemes based on hydrotreatment.

The commercial processes currently in existence perform the hydrotreatment of heavy hydrocarbons of petroleum under operating conditions with high pressures, in the range of 140 to 220 kg/cm$^2$ for fixed bed and ebullated-bed, which obtain high conversions. To maintain continuity in the operation of these processes, the formation of sediments and sludge is limited to a maximum content of 0.80% by weight.

The operation of the hydrotreatment processes of heavy hydrocarbons of petroleum at low pressures, less than 140 kg/cm$^2$, has been limited by the formation of sediments and sludge, which is a characteristic problem of these processes. The formation of sediments and sludge increases when the conversion of heavy fractions (boiling point>538° C.) to light fractions also increases or by reducing the pressure in the reactors. For this reason, the commercial processes of hydrocracking of heavy hydrocarbons operate under operating conditions with high pressures, above 140 kg/cm$^2$, in order to obtain attractive conversions of the heavy fractions.

As references of patents related with hydrotreatment processes of heavy hydrocarbons of petroleum, there are the following inventions:

The American patent U.S. Pat. No. 5,591,325 of Jan. 7, 1997, claims a catalytic process for hydrotreating heavy oils of petroleum in two stages. The first stage is carried out in a fixed bed reactor for a removal of no more than 80% of Nickel+Vanadium (Ni+V), preferably from 30 to 70%, although in the examples it states removals of between 45.3 and 47%. The operating conditions in this stage are as follows: temperature of between 320 and 410° C., pressure from 50 to 250 kg/cm$^2$, space velocity (LHSV) of 0.1 to 2.0 h$^{-1}$ and Hydrogen/Hydrocarbon ($H_2$/HC) ratio of 300 to 1,200 nl/l. The second stage is for the removal of sulfur, nitrogen and remaining metals in an ebullated-bed reactor in the following operating conditions: temperature of 350 to 450° C., pressure 50 to 250 kg/cm$^2$, LHSV of 0.2 to 10.0 h$^{-1}$ and $H_2$/HC ration of 500 to 3,000 nl/l.

In that regard, it is important to note that said patent precisely exemplifies hydrotreatment in two stages of reaction of an atmospheric residue in the following operating conditions: pressure of 150 kg/cm$^2$, LHSV of 0.2 h$^{-1}$, temperature of 370 and 395° C. for the first and second stages, respectively, and $H_2$/HC ratio of 700 nl/l, thereby obtaining total removals of Ni+V of 109 wppm, total nitrogen of 1,970 wppm, insolubles in n-$C_7$ (asphaltenes) of 6.6% by weight and total sulfur of 3.78% by weight, as well as a formation of sediments and sludge of 0.01% by weight. Said patent also claims the utilization of a catalyst based on a metal of the VIA, VIII and V groups for stage I and a catalyst with a hydrogenation metal supported in an organic oxide for stage II.

The American patent U.S. Pat. No. 5,779,992 of Jul. 14, 1998, which is in part a continuation of the American patent U.S. Pat. No. 5,591,325, relates to an apparatus which comprises: a') a fixed-bed reactor packed with a catalyst to hydrodemetallize a heavy oil of petroleum, and b') a suspended-bed reactor packed with a hydrodesulfurizing catalyst to hydrotreat the effluent product of the reactor of section a'). According to the apparatus of this invention, first a heavy oil of petroleum is fed into a fixed-bed reactor packed with a hydrodemetallization catalyst and then b) the heavy oil of petroleum hydrodemetallized in stage a) is fed to a suspended-bed reactor with a hydrodesulfurization catalyst in order to perform a deeper hydrotreatment thereof. The hydrotreatment may be carried out for a prolonged period of time. The operating conditions are similar to those described in U.S. Pat. No. 5,591,325.

The Mexican patent MX 179,301 of Aug. 25, 1995, granted to Instituto Mexicano del Petróleo [the Mexican Institute of Petroleum], provides a procedure for hydrotreating heavy crude oils to obtain synthetic crude, with an API gravity of gravity of 25 to 40. This process comprises the steps of: catalytic hydrotreatment of heavy crude oils with API gravity less than 24, with a final boiling temperature range from room temperature to 800° C. at a pressure of 760 mmHg and contaminant contents greater than 2% by weight of sulfur, 1,000 wppm of nitrogen, 150 wppm of metals (nickel and vanadium) and 5% by weight of asphaltenes; separation of the effluent from the reactor in a liquid phase and another phase of vapor, and carriage of the liquid phase to a scrubber. This process recovers a treated or improved crude with low contaminant content, being able to process as one feedstock 100% in a conventional refining scheme, increasing the yield of distillates and the quality thereof.

The U.S. Pat. No. 3,901,792 of Aug. 26, 1975 claims a method for demetallizing and desulfurizing crude or atmospheric residual in multiple stages. Initially, the heavy feedstock is introduced with hydrogen within an ebullated catalytic bed in the following operating conditions: pressure of 68 to 170 kg/cm$^2$, temperature of 387 to 440° C., LHSV of 0.20 to 1.5 h$^{-1}$, where the degree of demetallization is in the region of 50 to 80% by weight or more, depending on the quantity of nickel and vanadium of the feed. The light fraction leaves by the upper part of the reactor as acid gas for subsequent recovery of the light fractions of hydrocarbons, whereas the liquid effluent is conducted to a second stage of reaction mixed with a stream of hydrogen for its hydrodesulfurization in a bed of the same characteristics as that of the first stage. In the upper part of the reactor, the gaseous fraction is recovered for subsequent treatment thereof, whereas the liquid effluent recovered in this second reactor is conducted to a subsequent fractioning or treatment.

American patent U.S. Pat. No. 4,166,026 of Aug. 28, 1979, protects a two-stage process of hydrotreatment of heavy hydrocarbons, such as heavy crudes, topped crudes, vacuum residues or bituminous oils with a high content of asphaltenes, heavy metals and sulfur. The heavy oil is heated together with a stream of hydrogen for the first stage of hydrodemetallization and hydrocracking of the asphaltenes. The effluent after being subjected to this first stage, is conducted to a gas-liquid separator, where the gaseous fraction rich hydrogen, hydrogen sulfide and light hydrocarbons is conducted to a scrubber for the recovery of the light hydrocarbons, whereas the liquid effluent together with a part of the recirculating hydrogen passes to a second stage of reaction where the principal reactions of hydrodesulfurization and hydrodenitrogenation are effected. Subsequently, the effluent from this step is conducted to a gas-liquid separator, where the liquid product is recovered and conducted to separator to obtain a light fraction and a heavy fraction. Meanwhile, the gaseous fraction rich in hydrogen, hydrogen sulfide and light hydrocarbons is conducted to a scrubber for the recovery of the light hydrocarbons and the gaseous fraction rich in hydrogen and hydrogen for scrubbing in subsequent unit. The operating conditions in which the process operates preferably in both stages are as follows: pressure of 30 to 250 kg/cm$^2$, temperature of 350 to 450° C., $H_2$/HC ration of 100 to 2,000 normal liters per liter of charge and LHSV of 0.1 to 10.0 h$^{-1}$.

The process of the present invention presents considerable differences as regards objectives, operating conditions and results compared with those of the above references, since it is effected by a combination of low-pressure operating conditions, of the type of reactor and of the type of feedstock to be hydrotreated, which together provide a high capacity for removal of metals, sulfur, nitrogen and asphaltenes, as well as limiting the formation of sediments and sludge, to obtain a hydrotreated hydrocarbon of improved properties; which are presented with clarity and detail in the following chapters.

SPECIFICATION OF THE INVENTION

The present invention provides a process of the petroleum refining industry whereby a catalytic hydrotreatment of heavy hydrocarbons of petroleum is effected, in two stages of reaction that employ fixed-bed or ebullated-bed reactors, through the combination of low-pressure operating conditions, of the type of reactor and of the type of feedstock to be hydrotreated, which together provide a high capacity for removal of metals, sulfur, nitrogen and asphaltenes, as well as limiting the formation of sediments and sludge, to obtain a hydrotreated hydrocarbon of improved properties.

Among the heavy hydrocarbons of petroleum that can be hydrotreated with the process of the present invention are the heavy crudes, extra-heavy crudes, blends of heavy and light crudes and petroleum residuals, such as residues from atmospheric or vacuum distillation, which present an API gravity below 32° and a content of distillates recovered @ 538° C. less than 80% by volume.

Therefore, it is an objective of this invention to provide a process for the catalytic hydrotreatment of heavy hydrocarbons of petroleum, through the combination of low-pressure operating conditions, of the type of reactor and of the type of feedstock to be hydrotreated, which together limit the formation of sediments and sludge.

Another objective of the present invention is to provide a process for the catalytic hydrotreatment of heavy hydrocarbons of petroleum that present an API gravity below 32° and a content of distillates recovered @ 538° C. less than 80% by volume.

An added objective of the present invention is to provide a process for the catalytic hydrotreatment of heavy hydrocarbons of petroleum, whereby a hydrocarbon of improved properties is obtained with a minimum content of sediments and sludge.

A further objective of the present invention is to provide a process for the catalytic hydrotreatment of heavy hydrocarbons of petroleum that has a high capacity for removal of metals, of sulfur, of nitrogen and of asphaltenes, as well as limiting the formation of sediments and sludge.

An additional objective of the present invention is to provide a process for the catalytic hydrotreatment of heavy hydrocarbons of petroleum, whereby a hydrocarbon of improved properties is obtained that can be used as a feedstock to process in the conventional scheme of refining or be sold as a hydrocarbon of petroleum with improved properties.

Yet another objective of the present invention is to provide a process for the catalytic hydrotreatment of heavy hydrocarbons of petroleum, which can be situated before the conventional refining process.

SUMMARY OF THE INVENTION

The present invention provides a process for the catalytic hydrotreatment of heavy hydrocarbons of petroleum with a high content of contaminants (metals and asphaltenes), which operates in operating conditions with low-pressure, in combination with the type of reactor and the type of feedstock, which together limit the formation of sediments and sludge in the product and obtain a hydrotreated hydrocarbon of improved properties, with levels of contaminants, API gravity and distillates within the ranges commonly reported in the feedstocks typical to refining schemes.

More particularly, the present invention comprises the stages of: I) feeding the heavy hydrocarbons of petroleum to a fixed or ebullated-bed reactor packed with a hydrotreatment catalyst, whose principal effect is the hydrodemetallization and the hydrocracking of asphaltenes of the heavy hydrocarbons of petroleum, and, II) feeding the heavy hydrocarbon of petroleum hydrotreated in stage Ito a fixed or ebullated-bed reactor with a hydrotreatment catalyst, for a deeper effect of hydrodesulfurization of the heavy hydrocarbon of petroleum, whose content of total sulfur is reduced to a level required for its treatment in the conventional refining process or for its sale as a hydrocarbon of petroleum with improved properties.

Figure 1:
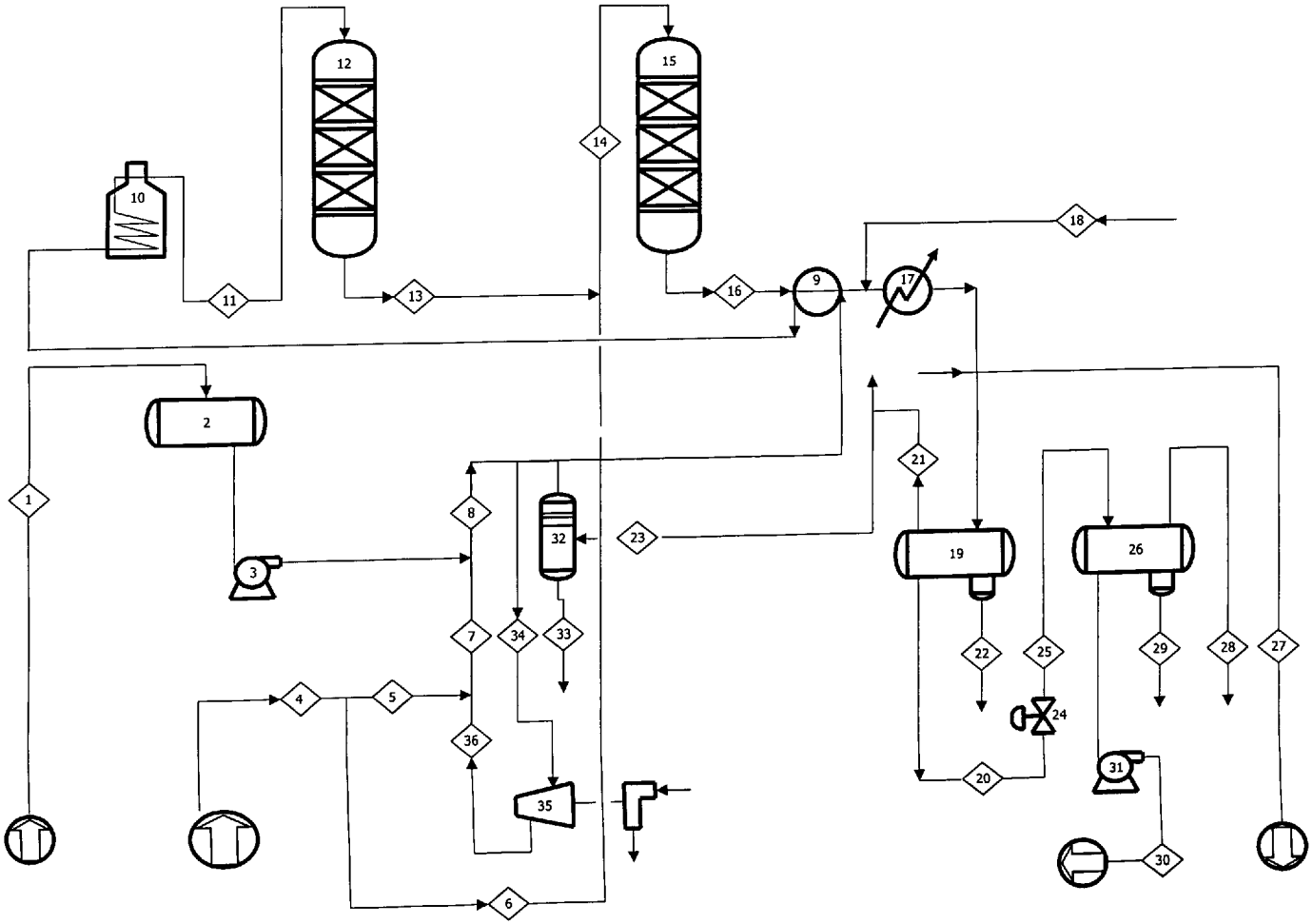
FIG. 1 represents a flow chart that illustrates the best way known to the applicant of carrying out the process suggested in the present invention and which serves as a reference in the examples of application, for obtaining a hydrotreated hydrocarbon of improved properties and a minimum content of sediments and sludge in the product.

Although the scheme of FIG. 1 illustrates specific dispositions of equipment whereby this invention may be put into practice, it must not be held to limit the invention to any specific equipment.

DETAILED DESCRIPTION OF THE INVENTION

Described below is the best method known to applicant for carrying out the hydrotreatment of heavy hydrocarbons of petroleum in two stages of reaction, in fixed or ebullated bed reactors, with different hydrotreatment catalysts, who principal effect is the hydrodemetallization of the heavy hydrocarbon of petroleum and the hydrocracking of asphaltenes in the first stage, and the hydrodesulfurization and hydrodenitrogenation of the heavy hydrocarbon of petroleum in the second stage, through the combination of low-pressure operating conditions, of the type of reactor and of the type of feedstock to be hydrotreated, which together provide a high capacity for removal of metals, sulfur, nitrogen and asphaltenes, as well as limiting the formation of sediments and sludge, to obtain a hydrotreated hydrocarbon of improved properties.

In general, there exists no limitation of the type of hydrocarbon to be employed as feed to the process of the present invention. Among the heavy hydrocarbons of petroleum are the heavy crudes, the extra-heavy crudes, blends of heavy and light crudes and petroleum residuals, such as residues from the atmospheric or vacuum distillation, which present a specific gravity less than 32° API and a content of distillates recovered @ 538° C. less than 80% by volume. The examples of application of the present invention include heavy crudes and residues, the latter resulting from atmospheric and vacuum distillations.

The present invention comprises the stages of:

I. Feeding the heavy hydrocarbons of petroleum to a fixed or ebullated-bed reactor with a hydrotreatment catalyst, whose principal effect is the hydrodemetallization of the heavy hydrocarbons of petroleum and the hydrocracking of asphaltenes, and II. Feeding the heavy hydrocarbon of petroleum hydrotreated in stage I to a fixed or ebullated-bed reactor with a hydrotreatment catalyst, for a deeper effect of hydrodesulfurization and hydrodenitrogenation of the heavy hydrocarbon of petroleum.

Due to the fact that heavy hydrocarbons of petroleum contain a large quantity of heavy compounds precursors of sediments and sludge, it is inevitable that they are formed during hydrotreatment, wherefore the process of the present invention is carried out by the combination of low-pressure operating conditions, of the type of reactor and of the type of feedstock to be hydrotreated, which together provide a high capacity for removal of metals, sulfur, nitrogen and asphaltenes, as well as limiting the formation of sediments and sludge, to obtain a hydrotreated hydrocarbon of improved properties.

In that, it is worth noting that the sludge and sediments are compounds that are produced during the hydrotreatment reactions through the hydrocracking of resins and light asphaltenic fractions, as well as by the dealkylation of heavy asphaltenes present in heavy hydrocarbons; by reducing the mutual solubility thereof, it causes sedimentation and the formation of sludge. Another source of formation of sediments is by the attrition of the hydrotreatment catalyst during the operation, which occurs preferably in ebullated-bed reactors.

It is also important to note that when the reaction is conducted at low pressures, as is done in the present invention, the hydrocracking of heavy fractions of heavy hydrocarbons of petroleum is carried out moderately, in such a way that a moderate conversion of the feedstock is also attained. It is also observed that when the process is performed in low-pressure operating conditions, this favors the formation of sediments and sludge, therefore the process of the present invention is carried out by the combination of low-pressure operating conditions, of the type of reactor and of the type of feedstock to be hydrotreated, which together limit the formation of sediments and sludge.

The applicant of the present invention has found that, surprisingly, the properties of the feedstock are improved and the formation of sediments and sludge in the product is limited by being carried out in two stages of reaction in the low-pressure operating conditions that are mentioned hereunder:

FRAME I
General operating conditions with low pressure

| PARAMETER | General range of operation |
|---|---|
| Pressure, kg/cm$^2$ | 40-130 |
| Temperature, ° C. | 320-450 |
| Space-velocity (LHSV), h$^{-1}$ | 0.2-3.0 |
| Hydrogen/Hydrocarbon ratio ($H_2$/HC), normal liters by liters of feedstock (nl/l) | 350-1,200 |

More specifically, the applicant has found that the low-pressure operating conditions for each step are:

FRAME II
General operating conditions with low pressure for the step I

| PARAMETER | Range of operation | Preferred range of operation |
|---|---|---|
| Catalyst | Selective towards hydrodemetallization of hydrocarbons and hydrocracking of asphaltenes | |
| Pressure, kg/cm$^2$ | 40-130 | 45-90 |
| Temperature, ° C. | 320-450 | 350-450 |
| Space-velocity (LHSV), h$^{-1}$ | 0.2-3.0 | 0.2-2 |
| Hydrogen/Hydrocarbon ratio ($H_2$/HC), nl/l | 350-1,200 | 450-1,050 |

FRAME III
General operating conditions with low pressure for the step II

| PARAMETER | Range of operation | Preferred range of operation |
|---|---|---|
| Catalyst | Selective towards hydrodesulfurization and hydrodenitrogenation of hydrocarbons | |
| Pressure, kg/cm$^2$ | 40-130 | 45-90 |
| Temperature, ° C. | 320-450 | 330-450 |
| Space-velocity (LHSV), h$^{-1}$ | 0.2-3.0 | 0.2-2 |
| Hydrogen/Hydrocarbon ratio ($H_2$/HC), nl/l | 350-1,200 | 450-1,050 |

It is important to note that the hydrotreatment catalysts used in the two stages of reaction differ in their physical, chemical and textural properties, which results in different selectivity for the removal of contaminants.

The hydrocarbons hydrotreated by the process of the present invention present considerable improvements in their properties, compared with the heavy hydrocarbon fed in, on modifying principally the following specific properties: API gravity up to approximately 15 units and content of distillates recovered @ 538° C. by up to approximately 50% by volume, compared with the feed, with a minimum content of sediments and sludge.

It should be noted that although high quantities of impurities are removed from the heavy hydrocarbon of petroleum, the process of the present invention by is being carried out through the combination of low-pressure operating conditions, of the type of reactor and of the type of feedstock to be hydrotreated, it unexpectedly maintains a low content of sediments and sludge, without producing blockages due to these materials during its continuous operation.

According to the process of the present invention, a mixture of heavy hydrocarbons of petroleum and hydrogen is preheated to then reach its reaction temperature in a direct fire heater.

In the first reaction stage, the mixture of heavy hydrocarbons of petroleum and hydrogen is fed to the catalytic hydrotreatment reactor in the conditions required for carrying out the reactions of hydrodemetallization and hydrocracking of asphaltenes principally, reducing the quantity of heavy metals (Nickel and Vanadium) and substantially increasing the volume of distillates. In parallel, other reactions such as hydrodesulfurization and hydrodenitrogenation are carried out.

Subsequently, the effluent from the first reaction stage passes to a second reaction stage of hydrotreatment, where deep hydrodesulfurization and hydrodenitrogenation are the principal reactions, reducing the total sulfur content to a level required in the product for its treatment in a conventional refining scheme. In parallel, other reactions such as hydrodemetallization and hydrocracking are carried out.

The hydrodemetallization catalyst (HDM) employed in the first reaction stage is a nickel-molybdenum-based catalyst, whereas the hydrodesulfurization catalyst (HDS) employed in the second reaction stage is a cobalt-molybdenum-based catalyst; both catalysts use a gamma alumina as support.

The HDM catalyst exhibits a low surface area and a pore diameter and pore volume higher than the HDS catalyst. The pores of the HDM catalyst are more concentrated in the region of 100 to 250 Angstrom (~70%) whereas for the HDS catalyst, the region with most concentration of pores is from 50 to 100 Angstrom (~60%). The HDM catalyst has approximately 20% of pores greater than 250 Angstrom, whereas this region of pores is less than 0.5% in the HDS catalyst (see Tables 3 and 18).

The principal advantage of the present invention is that the process of catalytic hydrotreatment of heavy hydrocarbons of petroleum, which present an API gravity lower than 25° and a content of distillates recovered @ 538° C. lower than 80% by volume, is carried out by the combination of low-pressure operating conditions, of the type of reactor and of the type of feedstock to be hydrotreated, which together provide a high capacity for removal of metals, sulfur, nitrogen and asphaltenes, as well as limiting the formation of sediments and sludge, to obtain a hydrotreated hydrocarbon of improved properties. The low-pressure operating conditions, in which the process of the present invention is carried out are, generally, those presented in Frame I, where as for each reaction stage there are specific or preferably ranges of low-pressure operating conditions as presented in Frames II and III respectively.

Specifically, described below is the flow chart of FIG. 1 which illustrates the best way known to the applicant for carrying out the process proposed in the present invention:

The heavy hydrocarbon of petroleum indicated in the line (1), is introduced to a feed tank (2), and is conducted through the pump (3) in order to be mixed with the hydrogen indicated with the line (7), which is constituted by a part of the fresh hydrogen (5) and recycle hydrogen (36).

The fresh hydrogen indicated by the line (4) is divided into two parts, the first part (5) is injected together with the recycle hydrogen (36) to the heavy hydrocarbon of petroleum (1), to be conducted mixed (8) to the catalytic reactor of stage I (12); and the second part (6) is sent to a the catalytic reactor of stage III (15).

The feed mixture of hydrogen (8) is preheated with the effluent from the reactor (16) through a heat exchanger (9), to then raise its temperature by means of a direct fire heater (10). The heated effluent (11) is conducted to the catalytic reactor of stage I (12) at the reaction temperature indicated in Frame II, in order to carry out principally the reactions of hydrodemetallization and hydrocracking, as well as complementary reactions to a lesser degree of hydrodesulfurization and hydrodenitrogenation.

The product hydrotreated in the first reaction stage (13) is mixed with another part of the fresh hydrogen indicated by the line (6), in order to form a stream (14) that is introduced to the catalytic reactor of stage II (15), where principally the reactions of hydrodesulfurization and hydrodenitrogenation are carried out, as well as complementary reactions to a lesser degree of hydrodemetallization and hydrocracking, according to the low-pressure operating conditions indicated in Frame III.

The product hydrotreated in the two reaction stages (16) is cooled by means of a heat exchanger (9), subjected to an injection of scrubbing water (18) and further cooled by means of a heat exchanger (17), in order to then be conducted to the high pressure separator (19), where the liquid-vapor separation is effected.

The separated vapor (21), basically constituted by hydrogen and hydrogen sulfide, is divided into two parts: a) the first part of the vapor (23) is conducted to a suction tank of the compressor (32), where the light liquid hydrocarbons are separated (33) from the stream rich in hydrogen (34) which is recycled into the process by the compressor (35); b) the second part of the vapor (27) is conducted to sour gas sweetening. Additionally, in this high-pressure separator, an excess of residual sour water is obtained which is conducted to water treatment.

The liquid effluent (22) that contains the ammonia salts dissolved in the sour water is separated from the hydrotreated product and conducted to water treatment.

The liquid effluent (20) from the high-pressure separator (19) is introduced to an expansion valve (24) to obtain a liquid-vapor stream (25), which is introduced to a second separator operated at low pressure (26), from which a stream of residual gas (28) is obtained, which is sent to gases treatment plant for the recovery of the light hydrocarbons obtained in the process of the present invention.

The liquid effluent (30) obtained in the low-pressure separator (26) is conducted through a pump (31) to battery limits for its processing in the conventional refining scheme or for its sale as a light hydrocarbon of petroleum. Additionally, an excess of residual sour water (29) is obtained in this separator, which is sent to water treatment.

EXAMPLES

To better illustrate the process of the present invention, below are examples to support the foregoing, which does not limit the scope of what is claimed herein.

Example 1

A specific application of the process of catalytic hydrotreatment of heavy hydrocarbons of petroleum, the motive of the present invention, to obtain a typical feedstock for a conventional refining scheme or for its sale as a hydrocarbon of improved properties, is the one that was carried out on hydrotreating heavy crude with the specific properties that are presented in Table 1, through the combination of low-pressure operating conditions that are shown in Table 2, in two stages of fixed-bed reaction and the use of hydrodemetallization (HDM) and hydrodesulfurization catalysts (HDS), whose properties are presented in Table 3; which together demonstrate that although surprisingly they achieve significant removal of metals, total sulfur, asphaltenes and total nitrogen, the formation of sediments and sludge is unexpectedly limited, and the hydrotreated hydrocarbon of improved properties that is presented in Table 4 is obtained.

Table 1 shows that the feed does not contain sediments and sludge, since these are formed when carrying out each of the reactions of the hydrotreatment process.

Table 4 shows that the metals are reduced, after the two reaction stages, from 353.5 wppm to 113.8 wppm, sulfur from 3.44% by weight to 0.66% by weight, asphaltenes from 12.4% by weight to 4.67% by weight and the total nitrogen from 3,700 wppm to 2,045 wppm.

TABLE 1

Properties of a heavy crude

| Properties | ASTM Method | Values |
|---|---|---|
| API Gravity | D-287 | 20.91 |
| Total sulfur, weight % | D-4294 | 3.44 |
| Total nitrogen, wppm | D-4629 | 3,700 |
| Asphaltenes, weight % | D-3279 | 12.4 |
| Metals, wppm | | |
| Ni + V | | 353.5 |
| Sediments and sludge, weight % | D-4870 | 0.0 |
| Composition, volume % | | |
| Fraction IBP-170° C. | | 15.6 |
| Fraction 170-360° C. | | 25.5 |
| Fraction 360-538° C. | | 21.4 |
| Fraction 538° C.$^+$ | | 37.5 |
| Fraction IBP-538° C.$^+$ | | 62.5 |

TABLE 2

Operating conditions with low pressure for the catalytic hydrotreatment of a heavy crude in two fixed-bed reactions stages

| Operating conditions | Stage I | Stage II |
|---|---|---|
| Temperature, ° C. | 400 | 400 |
| Pressure, kg/cm$^2$ | 70 | 70 |
| LHSV, h$^{-1}$ | 1.0 | 0.5 |
| $H_2$/HC ratio, nl/l | 890 | 890 |

Also, said table shows that when significant removals of contaminants are attained after performing the hydrotreatment (HDT) of the heavy crude, the formation of sediments and sludge is 0.65% by weight; a value lower than the acceptable limit of 0.8% by weight, in order to maintain continuity in the operation of these processes.

The same table reports that the API gravity increases from 20.91 to 28.93° API and the content of distillates recovered @ 538° C. from 62.5 to 88.1% by volume, obtaining a conversion of the feedstock of 68.3% by volume.

TABLE 3

Properties of HDM and HDS catalysts employed in each reaction stage

| Properties | HDM catalyst | HDS catalyst |
|---|---|---|
| Reaction stage | I | II |
| Physical properties | | |
| Size, cm. | 0.254 | 0.158 |
| Surface area, m$^2$/g | 175 | 248 |
| Pore volume, cm$^3$/g | 0.56 | 0.51 |
| Mean pore diameter, Å | 127 | 91 |
| Pore size distribution, vol % | | |
| <50 Å | 3.09 | 18.32 |
| 50-100 Å | 6.71 | 58.45 |
| 100-250 Å | 69.09 | 22.84 |
| 250-500 Å | 15.02 | 0.23 |
| 500-2000 Å | 6.09 | 0.16 |
| >2000 Å | — | — |
| Chemical properties | | |
| Molybdenum, weight % | 10.66 | 12.89 |
| Nickel, weight % | 2.88 | — |
| Cobalt, weight % | — | 2.5 |
| Sodium, wppm | 412 | — |
| Titania, weight % | 3.73 | 3.2 |

TABLE 4

Properties and composition of a hydrotreated crude

| Properties | ASTM Method | STAGE I | STAGE II |
|---|---|---|---|
| Number of reactors | | 1 | 1 |
| API Gravity | D-287 | 25.2 | 28.93 |
| Total sulfur, weight % | D-4294 | 1.77 | 0.66 |
| Total nitrogen, wppm | D-4629 | 2,616 | 2,045 |
| Asphaltenes, weight % | D-3279 | 8.29 | 4.67 |
| Metals, wppm | | | |
| Ni + V | | 228.7 | 113.8 |
| Sediments and sludge, wt % | D-4870 | 0.12 | 0.65 |
| Conversion, volume % | | 36.0 | 68.3 |

TABLE 4-continued

| Properties and composition of a hydrotreated crude | | | |
|---|---|---|---|
| Properties | ASTM Method | STAGE I | STAGE II |
| Composition, volume % | | | |
| Fraction IBP-170° C. | | 15.6 | 19.3 |
| Fraction 170-360° C. | | 28.1 | 37.6 |
| Fraction 360-538° C. | | 32.3 | 31.2 |
| Fraction 538° C.$^+$ | | 24.0 | 11.9 |
| Fraction IBP-538° C.$^+$ | | 76.0 | 88.1 |

The results obtained show that, with the process of catalytic hydrotreatment of heavy hydrocarbons of the present invention, through the combination of low-pressure operating conditions, of the type of reactor and of the type of feedstock to be hydrotreated, significant quantities of contaminants are removed and the formation of sediments and sludge is unexpectedly limited, to levels below the acceptable limit that guarantees the continuity of the industrial operation, further obtaining a notable conversion of the feedstock to produce a hydrotreated hydrocarbon of improved properties with levels of contaminants, API gravity and distillates within the ranges commonly reported in the feeds typical to refining schemes.

In that regard, it is important to note that the conversion of the feedstock is calculated with the following equation:

$$\text{Conversion} = \frac{(\text{Fraction } 538^\circ\text{ C.}^+ \text{ in the feedstock}) - (\text{Fraction } 538^\circ\text{ C.}^+ \text{ in the product})}{(\text{Fraction } 538^\circ\text{ C.}^+ \text{ in the feedstock})} \times 100$$

Example 2

Another specific application of the process of catalytic hydrotreatment of heavy hydrocarbons of petroleum of the present invention, is the one which was carried out on hydrotreating the heavy crude of example 1, with the specific properties reported in Table 1, through the combination of low-pressure operating conditions that are shown in Table 5, in a catalytic system in two stages of fixed-bed reaction and the use of HDM and HDS catalysts of example 1, whose properties are presented in Table 3; which together demonstrate notably that the formation of sediments and sludge is limited, as well as attaining significant removals of metals, total sulfur, asphaltenes and total nitrogen, and obtaining the hydrotreated hydrocarbon of improved properties shown in Table 6.

Unlike the previous example, for this specific application of the invention, only the pressure was modified (to a lower value) and the space velocity (to a higher value) in the second reaction stage of the process, in order to render the process even less severe, but preserving the other operating conditions of low pressure, of the type of reactor and the type of feedstock to be hydrotreated without any change.

TABLE 5

| Operating conditions with low pressure for the catalytic hydrotreatment of a heavy crude in two fixed-bed reactions stages | | |
|---|---|---|
| | Stage | |
| Operating conditions | I | II |
| Temperature, ° C. | 400 | 400 |
| Pressure, kg/cm$^2$ | 70 | 54 |
| LHSV, h$^{-1}$ | 1.0 | 1.0 |
| $H_2$/HC ratio, nl/l | 890 | 890 |

Table 6 shows that the metals are reduced, not so surprisingly as in example 1, but significantly so after the two reaction stages, from 353.5 wppm to 135 wppm, sulfur from 3.44% by weight to 0.802% by weight, asphaltenes from 12.4% by weight to 5.41% by weight and total nitrogen from 3,700 wppm to 2,310 wppm.

Furthermore, said table shows that even when there are important removals of contaminants after carrying out the HDT of the heavy crude, the formation of sediments and sludge is surprisingly 0.32% by weight; a value notably lower than the acceptable limit of 0.8% by weight, to maintain the continuity of the operation of this type of processes.

TABLE 6

| Properties and composition of a hydrotreated crude | | | |
|---|---|---|---|
| Properties | ASTM Method | STAGE I | STAGE II |
| Number of reactors | | 1 | 1 |
| API Gravity | D-287 | 25.2 | 27.52 |
| Total sulfur, weight % | D-4294 | 1.77 | 0.802 |
| Total nitrogen, wppm | D-4629 | 2,616 | 2,310 |
| Asphaltenes, weight % | D-3279 | 8.29 | 5.41 |
| Metals, wppm | | | |
| Ni + V | | 228.7 | 135 |
| Sediments and sludge, wt % | D-4870 | 0.12 | 0.32 |
| Conversion, volume % | | 36.0 | 42.4 |
| Composition, volume % | | | |
| Fraction IBP-170° C. | | 15.6 | 16.8 |
| Fraction 170-360° C. | | 28.1 | 28.6 |
| Fraction 360-538° C. | | 32.3 | 33.0 |
| Fraction 538° C.$^+$ | | 24.0 | 21.6 |
| Fraction IBP-538° C.$^+$ | | 76.0 | 78.4 |

The same table reports that the API gravity increases from 20.91 to 27.52° API and the content of distillates recovered @ 538° C. from 62.5 to 78.4% by volume, obtaining a conversion of the feed of 42.4% by volume, a value lower than the one obtained in example 1, but at the same time significant, given that the severity of the process was able to be reduced.

The results obtained confirm that the present invention, in one of its preferred modalities, by rendering the process of catalytic hydrotreatment of heavy hydrocarbons less severe, through the combination of low-pressure operating conditions, of the type of reactor and of the type of feedstock to be hydrotreated, surprisingly limits the formation of sediments and sludge, to levels notably lower than the acceptable limit that guarantees continuity of the industrial operation, even though significant quantities of contaminants are removed and a notable conversion of the charge is attained to produce a hydrotreated hydrocarbon of improved properties.

Example 3

Another specific application of the present invention, to obtain a typical feed for a conventional refining scheme or for its sale as a hydrocarbon of improved properties, was done by carrying out the catalytic hydrotreatment of the heavy crude of examples 1 and 2, with the specific properties reported in Table 1, through the combination of: the low-pressure operating conditions shown in Table 7, in a catalytic system in two stages of fixed-bed reaction and the use of HDM and HDS catalysts of examples 1 and 2, whose properties are shown in Table 3; which together demonstrate that the formation of sediments and sludge is limited, in addition to attaining significant removals of metals, total sulfur, asphaltenes and total nitrogen, and obtaining the hydrotreated hydrocarbon of improved properties shown in Table 8.

Unlike example 1, for this specific application of the invention, only the space velocity was modified (to a higher value, as in example 2) in the second reaction stage of the process, in order to render the process less severe than that of example 1 but more than example 2, preserving the other operating conditions of low pressure, of the type of reactor and the type of feed to be hydrotreated without any change.

TABLE 7

Operating conditions with low pressure for the catalytic hydrotreatment of a heavy crude in two fixed-bed reactions stages

| Operating conditions | Stage I | Stage II |
|---|---|---|
| Temperature, ° C. | 400 | 400 |
| Pressure, kg/cm$^2$ | 70 | 70 |
| LHSV, h$^{-1}$ | 1.0 | 1.0 |
| $H_2$/HC ratio, nl/l | 890 | 890 |

Table 8 reports that the metals are reduced, almost as surprisingly as in example 1 after the two reaction stages, from 353.5 wppm to 119.4 wppm, sulfur from 3.44% by weight to 0.75% by weight, asphaltenes from 12.4% by weight to 4.72% by weight and total nitrogen from 3,700 wppm to 2,075 wppm.

Furthermore, said table shows that even though there are significant removals of contaminants after carrying out the HDT of the heavy crude, the formation of sediments and sludge is 0.53% by weight; a value evidently lower than the acceptable limit of 0.80% by weight, for maintaining continuity in the operation of this type of processes.

TABLE 8

Properties and composition of a hydrotreated crude

| Properties | ASTM Method | STAGE I | STAGE II |
|---|---|---|---|
| Number of reactors | | 1 | 1 |
| API Gravity | D-287 | 25.2 | 27.99 |
| Total sulfur, weight % | D-4294 | 1.77 | 0.75 |
| Total nitrogen, wppm | D-4629 | 2,616 | 2,075 |
| Asphaltenes, weight % | D-3279 | 8.29 | 4.72 |
| Metals, wppm | | | |
| Ni + V | | 228.7 | 119.4 |
| Sediments and sludge, wt % | D-4870 | 0.12 | 0.53 |
| Conversion, volume % | | 36.0 | 56.0 |

TABLE 8-continued

Properties and composition of a hydrotreated crude

| Properties | ASTM Method | STAGE I | STAGE II |
|---|---|---|---|
| Composition, volume % | | | |
| Fraction IBP-170° C. | | 15.6 | 17.5 |
| Fraction 170-360° C. | | 28.1 | 33.9 |
| Fraction 360-538° C. | | 32.3 | 32.1 |
| Fraction 538° C.$^+$ | | 24.0 | 16.5 |
| Fraction IBP-538° C.$^+$ | | 76.0 | 83.5 |

The same table reports that the API gravity increases from 20.91 to 27.99° API and the content of distillates recovered @ 538° C. from 62.5 to 83.5% by volume, thereby obtaining a conversion of the feed of 56.0% by volume, a value lower than the one obtained in example 1 and higher than that of example 2, but significant however, given that the process was able to be operated at an intermediate level of severity, with respect to examples 1 and 2.

The results obtained reaffirm that with the process of catalytic hydrotreatment of heavy hydrocarbons of the present invention, with significant removals of contaminants, the formation of sediments and sludge is surprisingly limited to levels notably lower than the acceptable limit that guarantees continuity of the industrial operation of the process and a hydrotreated hydrocarbon of improved properties is obtained with levels of contaminants, API gravity and distillates within the ranges commonly reported in the feedstocks typical to refining schemes.

Example 4

An additional specific application of the present invention is one that was carried out by hydrotreating in two runs the heavy crude of examples 1 through 3, with the specific properties reported in Table 1, through the combination of the low-pressure operating conditions shown in Table 9, in a catalytic system in two stages of fixed-bed reaction and the use of HDM and HDS catalysts of examples 1 through 3, whose properties are shown in Table 3; which together in a surprisingly notable manner demonstrate that the formation of sediments and sludge is limited, which is a viable option for obtaining feedstocks typical to the conventional refining schemes or for sale as a hydrotreated hydrocarbon of improved properties, as is reported in Table 10.

Unlike example 1, for this specific application of the invention, modifications were made to the temperature (to lower values), the pressure (to a lower value) and the space velocity (to a higher value) in the second reaction stage of the process, in order to render the process even less severe, preserving the other operating conditions of low pressure, of the type of reactor and the type of feed to be hydrotreated without any change.

TABLE 9

Operating conditions with low pressure for the catalytic hydrotreatment of a heavy crude in two fixed-bed reactions stages

| Operating conditions | Stage I | Stage II | Stage II |
|---|---|---|---|
| Temperature, ° C. | 400 | 360 | 380 |
| Pressure, kg/cm$^2$ | 70 | 54 | 54 |

TABLE 9-continued

Operating conditions with low pressure for the catalytic hydrotreatment of a heavy crude in two fixed-bed reactions stages

| Operating conditions | Stage I | Stage II | Stage II |
|---|---|---|---|
| LHSV, $h^{-1}$ | 1.0 | 1.0 | 1.0 |
| $H_2$/HC ratio, nl/l | 890 | 890 | 890 |

Table 10 reports that the metals are reduced, not so surprisingly as in example 1 but significantly so after the HDT, from 353.5 wppm to 149.7 and 138.4 wppm, sulfur from 3.44% by weight to 1.12 and 0.89% by weight, asphaltenes from 12.4% by weight to 6.41 and 5.65% by weight and total nitrogen from 3,700 wppm to 2,381 and 2,315 wppm, for each run at operating temperatures of 360 and 380° C. in the second reaction stage, respectively.

TABLE 10

Properties and composition of a hydrotreated crude

| Properties | ASTM Method | STAGE I | STAGE II | |
|---|---|---|---|---|
| Operating temperature, ° C. | | 400 | 360 | 380 |
| Number of reactors | | 1 | 1 | 1 |
| API Gravity | D-287 | 25.2 | 26.28 | 26.72 |
| Total sulfur, weight % | D-4294 | 1.77 | 1.12 | 0.89 |
| Total nitrogen, wppm | D-4629 | 2,616 | 2,381 | 2,315 |
| Asphaltenes, weight % | D-3279 | 8.29 | 6.41 | 5.65 |
| Metals, wppm | | | | |
| Ni + V | | 228.7 | 149.7 | 138.4 |
| Sediments and sludge, wt % | D-4870 | 0.12 | 0.21 | 0.26 |
| Conversion, volume % | D-4870 | 36.0 | 36.3 | 39.7 |
| Composition, volume % | | | | |
| Fraction IBP-170° C. | | 15.6 | 16.2 | 16.5 |
| Fraction 170-360° C. | | 28.1 | 28.0 | 28.3 |
| Fraction 360-538° C. | | 32.3 | 31.9 | 32.6 |
| Fraction 538° C.$^+$ | | 24.0 | 23.9 | 22.6 |
| Fraction IBP-538° C.$^+$ | | 76.0 | 76.1 | 77.4 |

Furthermore, said table shows that even though there are significant removals of contaminants after carrying out the HDT of the heavy crude, the formation of sediments and sludge is quite surprising, 0.21 and 0.26% by weight for each run in the second stage at 360 and 380° C. of reaction temperature, respectively; these values are notably lower than the acceptable limit of 0.8% by weight, for maintaining the continuity in the operation of these kinds of processes.

The same table shows for each run that the API gravity increases from 20.91 to 26.28 and 26.72° API and the content of distillates recovered @ 538° C. from 62.5 to 76.1 and 77.4% by volume, thereby obtaining a conversion of the feed of 36.3 and of 39.7% by volume, which are values lower than the one obtained in example 1, but at the same time signification given that the severity of the process was able to be reduced.

The results obtained confirm that the present invention, in two of its preferred modalities, by rendering the process of catalytic hydrotreatment of heavy hydrocarbons even less severe, through the combination of low-pressure operating conditions, of the type of reactor and of the type of feedstock to be hydrotreated, it surprisingly limits the formation of sediments and sludge, to levels notably lower than the acceptable limit that guarantees continuity of the industrial operation, even though significant quantities of contaminants are removed and a notable conversion of the feed is attained to produce a hydrotreated hydrocarbon of improved properties.

Example 5

In another specific application of the present invention, to obtain a typical feedstock for a conventional refining scheme or for its sale as a hydrocarbon of improved properties, it was carried out by hydrotreating in two runs the residue of atmospheric distillation with the specific properties shown in Table 11, through the combination of low-pressure operating conditions that are shown in Table 12, in two stages of fixed-bed reaction and the use of the hydrodemetallization (HDM) and hydrodesulfurization catalysts (HDS) of the foregoing examples, whose properties are presented in Table 3; which together demonstrate that even though significant removals of metals, total sulfur, asphaltenes and total nitrogen are attained, the formation of sediments and sludge is unexpectedly limited and the hydrotreated hydrocarbon of improved properties presented in Table 13 is obtained.

Unlike the previous examples, for this specific application of the invention, a much heavier hydrocarbon of petroleum (with a lower value of specific gravity, a higher quantity of contaminants and a lower content of distillates recovered @ 538° C.) was used, varying the other low-pressure operating conditions in a similar manner to the aforementioned examples and preserving the same type of reactor.

TABLE 11

Properties of a residue of atmospheric distillation

| Properties | ASTM Method | Values |
|---|---|---|
| API Gravity | D-287 | 7.14 |
| Total sulfur, weight % | D-4294 | 4.60 |
| Total nitrogen, wppm | D-4629 | 5,086 |
| Asphaltenes, weight % | D-3279 | 17.74 |
| Metals, wppm | | |
| Ni + V | | 575.6 |
| Sediments and sludge, weight % | D4870 | <0.01 |
| Composition, volume % | | |
| Fraction IBP-170° C. | | 0.0 |
| Fraction 170-360° C. | | 1.1 |
| Fraction 360-538° C. | | 34.9 |
| Fraction 538° C.$^+$ | | 64.0 |
| Fraction IBP-538° C.$^+$ | | 36.0 |

Table 11 shows that the feedstock contains almost no sediments and sludge, since these are formed by carrying out each of the reactions of the hydrotreatment process.

TABLE 12

Operating conditions with low pressure for the catalytic hydrotreatment of a residue of atmospheric distillation in two fixed-bed reactions stages

| Operating conditions | Stage I | Stage II | Stage II |
|---|---|---|---|
| Temperature, ° C. | 400 | 400 | 400 |
| Pressure, kg/cm$^2$ | 70 | 70 | 70 |
| LHSV, $h^{-1}$ | 1.0 | 1.0 | 0.5 |
| $H_2$/HC ratio, nl/l | 890 | 890 | 890 |

Table 13 reports that that metals are reduced, surprisingly as in example 1 after the HDT, from 575.6 wppm to 277.8 and 217.5 wppm, sulfur from 4.60% by weight to 1.18 and 1.02% by weight, asphaltenes from 17.74% by weight to 10.8 and 9.15% by weight and total nitrogen from 5,086 wppm to 3,040 and 2,706 wppm, for each run at operating space velocities (LHSV) of 1.0 and of 0.5 $h^{-1}$ in the second reaction stage, respectively.

Furthermore, said table shows that even though there are significant removals of contaminants after effecting the HDT of the residue of atmospheric distillation, the formation of sediments and sludge is unexpectedly 0.035 and 0.044% by weight for each run in the second stage at 1.0 and 0.5 $h^{-1}$ of reaction space velocities (LHSV), respectively; these values are surprising lower than the acceptable limit of 0.8% by weight, for maintaining the continuity in the operation of this type of processes.

TABLE 13

Properties and compositions of hydrotreated residua

| Properties | ASTM Method | STAGE I | STAGE II | |
|---|---|---|---|---|
| Number of reactors | | 1 | 1 | 1 |
| LHSV, $h^{-1}$ | | 1.0 | 1.0 | 0.5 |
| API Gravity | D-287 | 13.94 | 16.85 | 17.73 |
| Total sulfur, weight % | D-4294 | 2.47 | 1.18 | 1.02 |
| Total nitrogen, wppm | D-4629 | 4,520 | 3,040 | 2,706 |
| Asphaltenes, weight % | D-3279 | 12.76 | 10.8 | 9.15 |
| Metals, wppm | | | | |
| Ni + V | | 364.9 | 277.8 | 217.5 |
| Sediments and sludge, wt % | | 0.028 | 0.035 | 0.044 |
| Conversion, volume % | | 22.3 | 37.7 | 51.7 |
| Composition, volume % | | | | |
| Fraction IBP-170° C. | | 1.7 | 3.7 | 3.8 |
| Fraction 170-360° C. | | 12.9 | 16.3 | 20.6 |
| Fraction 360-538° C. | | 35.7 | 40.1 | 44.7 |
| Fraction 538° C.$^+$ | | 49.7 | 39.9 | 30.9 |
| Fraction IBP-538° C.$^+$ | | 50.3 | 60.1 | 69.1 |

The same table reports for each run that the API gravity increases from 7.14 to 16.85 and 17.73° API, and the content of distillates recovered @ 538° C. from 36.0 to 60.1 and 69.1% by volume, thereby obtaining a conversion of the feed of 37.7 and of 51.7% by volume; these conversions are lower than the one obtained in example 1, but at the same time are significant, given that it was able to hydrotreat a much heavier hydrocarbon of petroleum with a lower value of specific gravity, a higher quantity of contaminants and a lower content of distillates recovered @ 538° C.

The results obtained confirm that the present invention, in two of its preferred modalities, by hydrotreating an extremely heavy hydrocarbon of petroleum, through the combination of low-pressure operating conditions, of the type of reactor and of the type of feedstock to be hydrotreated, removes significant quantities of contaminants and unexpectedly limits the formation of sediments and sludge, to levels surprisingly lower than the acceptable limit that guarantees the continuity of the industrial operation, thereby also obtaining a notable conversion of the feed to produce a hydrotreated hydrocarbon of improved properties with levels of contaminants, API gravity and distillates within the ranges commonly reported in the feedstock typical to refining schemes.

Example 6

Another specific application of the process of catalytic hydrotreatment of heavy hydrocarbons of petroleum of the present invention is one which was carried out on hydrotreating the atmospheric residue of example 5, with the specific properties reported in Table 11, through the combination of the low-pressure operating conditions shown in Table 14, in a catalytic system in two stages of fixed-bed reaction and the use of HDM and HDS catalysts of the previous examples, whose properties are presented in Table 3; which together notably demonstrate that the formation of sediments and sludge is limited, as well as attaining significant removals of metals, total sulfur, asphaltenes and total nitrogen, and obtaining the hydrotreated hydrocarbon of improved properties shown in Table 15.

Unlike the previous example, for this example only the temperature was modified (to lower and higher values), to vary in both senses the severity of the process, preserving the other operating conditions of low pressure, of the type of reactor and of the type of feed to be hydrotreated without any change.

Table 15 reports that the metals are reduced, as in examples 1 and 5 after the HDT, from 575.6 wppm to 304 and 231.9 wppm, sulfur from 4.60% by weight to 1.32 and 0.95% by weight, asphaltenes from 17.74% by weight to 11.25 and 9.21% by weight and total nitrogen from 5,086 wppm to 3,340 and 2,690 wppm, for each run at operating temperatures of 380 and 420° C. in the second reaction stage, respectively.

Furthermore, said table shows that even though there are significant removals of contaminants after carrying out the HDT of the residue of atmospheric distillation, the formation of sediments and sludge is unexpectedly 0.03 and 0.09% by weight for each run in the second reaction stage at 380 and 420° C. of reaction temperature, respectively; these values are surprisingly lower than the acceptable limit of 0.8% by weight, for maintaining the continuity in the operation of this type of processes.

TABLE 14

Operating conditions with low pressure for the catalytic hydrotreatment of a residue of atmospheric distillation in two fixed-bed reactions stages

| Operating conditions | Stage I | Stage II | Stage II |
|---|---|---|---|
| Temperature, ° C. | 400 | 380 | 420 |
| Pressure, kg/cm$^2$ | 70 | 70 | 70 |
| LHSV, $h^{-1}$ | 1.0 | 1.0 | 1.0 |
| $H_2$/HC ratio, nl/l | 890 | 890 | 890 |

The same table reports for each run that the API gravity is increased from 7.14 to 14.72 and 19.39° API and the content of distillates recovered @ 538° C. from 36.0 to 56.0 and 66.0% by volume, thereby obtaining a conversion of the feed of 31.3 and of 46.9% by volume; conversions lower than the one obtained in examples 1 and 5, but equally significant.

The results obtained confirm that the present invention, in two of its preferred modalities, by hydrotreating an extremely heavy hydrocarbon of petroleum, through the combination of operating conditions of low pressure, of the type of reactor and of the type of feedstock to be hydrotreated, removes significant quantities of contaminants and unexpectedly limits the formation of sediments and sludge, to levels surprisingly lower than the acceptable limit that guarantees the continuity of the industrial operation, thereby also obtaining a notable conversion of the feedstock to produce a hydrotreated hydrocarbon of improved properties.

TABLE 15

Properties and compositions of hydrotreated residua

| Properties | ASTM Method | STAGE I | STAGE II | |
|---|---|---|---|---|
| Number of reactors | | 1 | 1 | 1 |
| Operating Temp., ° C. | | 400 | 380 | 420 |
| API Gravity | D-287 | 13.94 | 14.72 | 19.39 |
| Total sulfur, weight % | D-4294 | 2.47 | 1.32 | 0.95 |
| Total nitrogen, wppm | D-4629 | 4,520 | 3,340 | 2,690 |
| Asphaltenes, weight % | D-3279 | 12.76 | 11.25 | 9.21 |
| Metals, wppm | | | | |
| Ni + V | | 364.9 | 304 | 231.9 |
| Sediments and sludge, wt % | D-4870 | 0.028 | 0.03 | 0.09 |
| Conversion, volume % | | 22.3 | 31.3 | 46.9 |
| Composition, volume % | | | | |
| Fraction IBP-170° C. | | 1.7 | 2.8 | 2.8 |
| Fraction 170-360° C. | | 12.9 | 15.9 | 21 |
| Fraction 360-538° C. | | 35.7 | 37.3 | 42.2 |
| Fraction 538° C.$^+$ | | 49.7 | 44.0 | 34.0 |
| Fraction IBP-538° C.$^+$ | | 50.3 | 56.0 | 66.0 |

Example 7

Another specific application of the process of catalytic hydrotreatment of heavy hydrocarbons of petroleum of the present invention, is the one which was carried out by hydrotreating a residue of atmospheric distillation with properties different to the one employed in examples 5 and 6, with the specific properties shown in Table 16, through the combination of low-pressure operating conditions that are detailed in Table 17, a catalytic system in two stages of fixed-bed reaction and the use, in both reaction stages, of a mixture of hydrocracking catalysts (used and new) in a proportion of 70/30% by weight used catalyst/new catalyst, whose properties are presented in Table 18; which together demonstrate notably that the formation of sediments and sludge is limited, as well as attaining significant removals of metals, total sulfur, asphaltenes and total nitrogen, and obtaining the hydrotreated hydrocarbon of improved properties shown in Table 19.

Unlike examples 5 and 6, for this specific application of the invention, the same type of feedstock to be hydrotreated was used but a little less heavy (with a higher specific gravity value, a lower quantity of contaminants and a higher content of distillates recovered @ 538° C.), varying the space velocity (to lower values) and the hydrogen/hydrocarbon ratio (to lower values), besides including in this modality the use of hydrogen with a different degree of purity, in order to vary in both senses the severity of the process, maintaining the other low-pressure operating conditions in a similar manner to the aforementioned examples and preserving the same type of reactor.

TABLE 16

Properties of a residue of atmospheric distillation

| Properties | ASTM Method | Values |
|---|---|---|
| API Gravity | D-287 | 9.25 |
| Total sulfur, weight % | D-4294 | 3.74 |
| Total nitrogen, wppm | D-4629 | 4,400 |
| Ramsbottom carbon, weight % | D-524 | 13.39 |
| Asphaltenes, weight % | D-3279 | 10.18 |

TABLE 16-continued

Properties of a residue of atmospheric distillation

| Properties | ASTM Method | Values |
|---|---|---|
| Metals, wppm | | |
| Ni + V | | 353 |
| Sediments and sludge, weight % | D4870 | 0.0 |
| Fraction 538° C.$^+$, volume % | | 56.2 |
| Fraction IBP-538° C.$^+$, volume % | | 43.8 |

TABLE 17

Operating conditions with low pressure for the catalytic hydrotreatment of a residue of atmospheric distillation in two fixed-bed reactions stages

| | Stage | | |
|---|---|---|---|
| Operating conditions | I and II | I and II | I and II |
| Temperature, ° C. | 400 | 400 | 400 |
| Pressure, kg/cm$^2$ | 70 | 70 | 70 |
| LHSV, h$^{-1}$ | 0.284 | 0.33 | 0.33 |
| $H_2$/HC ratio, nl/l | 534 | 534 | 534 |
| Purity of hydrogen, mole % | 75 | 75 | 100 |

Table 16 shows that the feed contains no sediments and sludge, since these are formed on carrying out each of the reactions of the hydrotreatment process.

Table 19 reports that the metals are reduced, surprisingly as in the previous examples after the HDT, from 353 wppm to 126, 176 and 120 wppm, sulfur from 3.74% by weight to 1.297, 1.75 and 1.71% by weight, asphaltenes from 10.18% by weight to 5.64, 5.41 and 5.19% by weight and total nitrogen from 4,400 wppm to 3,515, 3,990 and 3,740 wppm, for each run at different space velocities and hydrogen purities, respectively.

Furthermore, said table shows that even though there are significant removals of contaminants after effecting the HDT of the residue of atmospheric distillation, the formation of sediments and sludge is surprisingly less than 0.05% by weight for the three runs in the second reaction stage; these values are notably lower than the acceptable limit of 0.8% by weight, for maintaining the continuity in the operation of this type of processes.

TABLA 18

Properties of the used and new HDM catalysts employed in each reaction stage

| | CATALYST | |
|---|---|---|
| Properties | Used | New |
| Physical properties | | |
| Size, inches | 1/32 | 1/32 |
| Surface area, m$^2$/g | 69.5 | 158 |
| Pore volume, cm$^3$/g | 0.27 | 0.67 |
| Mean pore diameter, Å | 147 | 148 |
| Pore size distribution, volume % | | |
| <50 Å | 2.45 | 0.0 |
| 50–100 Å | 53.94 | 40.0 |
| 100–250 Å | 34.0 | 52.11 |
| 250–500 Å | 4.88 | 4.71 |
| 500–2000 Å | 4.73 | 3.18 |

TABLA 18-continued

| Properties of the used and new HDM catalysts employed in each reaction stage | | |
|---|---|---|
| | CATALYST | |
| Properties | Used | New |
| Chemical properties | | |
| Molybdenum, weight % | 3.64 | 8.33 |
| Nickel, weight % | 2.78 | 2.68 |
| Vanadium, weight % | 8.64 | — |
| Sodium, weight % | 0.18 | 0.037 |
| Iron, weight % | 0.11 | — |
| Sulfur, weight % | 17.17 | — |
| Carbon, weight % | 22.59 | — |

TABLE 19

| Properties and compositions of hydrotreated residua | | | | |
|---|---|---|---|---|
| Properties | ASTM Method | Hydrotreated product (Stage II) | | |
| LHSV, $h^{-1}$ | | 0.284 | 0.33 | 0.33 |
| Purity of hydrogen, mole % | | 75 | 75 | 100 |
| API Gravity | D-287 | 16.70 | 15.39 | 15.70 |
| Total sulfur, weight % | D-4294 | 1.297 | 1.75 | 1.71 |
| Total nitrogen, wppm | D-4629 | 3,515 | 3,990 | 3,740 |
| Asphaltenes, weight % | D-3279 | 5.64 | 5.41 | 5.19 |
| Metals, wppm | | | | |
| Ni + V | | 126 | 176 | 120 |
| Sediments and sludge, weight % | D-8470 | <0.05 | <0.05 | <0.05 |

The same table reports for each run that the API gravity is increased from 9.25 to 16.70, 15.39 and 15.7° API.

The results obtained confirm that the present invention, in three of its preferred modalities, by hydrotreating a heavy hydrocarbon of petroleum, through the combination of operating conditions of low pressure, of the type of reactor and of the type of feedstock to be hydrotreated, removes significant quantities of contaminants and unexpectedly limits the formation of sediments and sludge, to levels surprisingly lower than the acceptable limit that guarantees the continuity of the industrial operation, to produce a hydrotreated hydrocarbon of improved properties.

Example 8

Another specific modality of the process of catalytic hydrotreatment of heavy hydrocarbons of petroleum of the present invention, is the one which was carried out by hydrotreating the same residue of atmospheric distillation employed in example 7, with the specific properties shown in Table 16, through the combination of low-pressure operating conditions that are detailed in Table 17, a catalytic system in two stages of ebullated-bed reaction and the use, in both reaction stages, of a mixture of hydrocracking catalysts (used and new) in a proportion of 70/30% by weight used catalyst/new catalyst, whose properties are presented in Table 18; which together demonstrate notably that the formation of sediments and sludge is limited, as well as attaining significant removals of metals, total sulfur, asphaltenes and total nitrogen, and obtaining the hydrotreated hydrocarbon of improved properties shown in Table 20.

Unlike the previous example, for this specific application of the invention, only the type of reactor was changed in the two reaction stages (to the ebullated-bed type), maintaining the same low-pressure operating conditions similar to the aforementioned example, to observe the sensitivity of the process to this change.

Table 20 reports that the metals are reduced, surprisingly as in the previous example after the HDT, from 353 wppm to 129, 170 and 150 wppm, sulfur from 3.74% by weight to 1.70, 1.85 and 1.76% by weight, asphaltenes from 10.18% by weight to 4.78, 5.68 and 5.66% by weight and total nitrogen from 4,400 wppm to 3,580, 3,650 and 3,610 wppm, for each run at different space velocities and hydrogen purity, respectively.

TABLE 20

| Properties and compositions of residua in an ebullated-bed reactor | | | | |
|---|---|---|---|---|
| Properties | ASTM Method | Hydrotreated product (Stages I and II) | | |
| LHSV, $h^{-1}$ | | 0.284 | 0.33 | 0.33 |
| Purity of hydrogen, mole % | | 75 | 75 | 100 |
| API Gravity | D-287 | 17.07 | 16.25 | 16.85 |
| Total sulfur, weight % | D-4294 | 1.70 | 1.85 | 1.76 |
| Total nitrogen, wppm | D-4629 | 3,580 | 3,650 | 3,610 |
| Asphaltenes, weight % | D-3279 | 4.78 | 5.68 | 5.66 |
| Metals, wppm | | | | |
| Ni + V | | 129 | 170 | 150 |
| Sediments and sludge, weight % | D-8470 | 0.56 | 0.47 | 0.54 |
| Conversion, volume % | | 7.8 | 9.3 | 14.2 |
| | Composition, volume % | | | |
| Fraction IBP-170° C. | | 2.5 | 2.4 | 2.4 |
| Fraction 170–360° C. | | 23.2 | 20.8 | 18.4 |
| Fraction 360–538° C. | | 22.5 | 25.8 | 31.0 |
| Fraction 538° C.+ | | 51.8 | 51.0 | 48.2 |
| Fraction IBP-538° C.+ | | 48.2 | 49.0 | 51.8 |

Furthermore, said table shows that even though there are significant removals of contaminants after carrying out the HDT of the residue of atmospheric distillation, the formation of sediments and sludge is surprisingly 0.56, 0.47 and 0.54% by weight for the three runs in the second reaction stage, respectively; these values are evidently higher than those of the previous example but notably lower than the acceptable limit of 0.8% by weight, for maintaining the continuity in the operation of this type of processes.

The same table reports for each run that the API gravity increases from 9.25 to 17.07, 16.25 and 16.85° API.

The results obtained reaffirm that the present invention, in three of its preferred modalities, by hydrotreating a heavy hydrocarbon of petroleum, through the combination of operating conditions of low pressure, of the type of reactor and of the type of feedstock to be hydrotreated, removes significant quantities of contaminants and unexpectedly limits the formation of sediments and sludge, to levels surprisingly lower than the acceptable limit that guarantees the continuity of the industrial operation, to produce a hydrotreated hydrocarbon of improved properties.

To further support the innovation and inventive activity of the present invention, below are provided examples of application that support the foregoing and which demonstrate that the catalytic hydrotreatment of heavy hydrocarbons of petroleum carried out in operating conditions different to those set forth in the present invention improve the properties of the feedstock and remove large quantities of contaminants, as in the present invention, in exchange for a considerable formation of sediments and sludge in the product, which prevent the continuous operation of such processes, which is the main objective of technical developments of this kind.

Example 9

This example does not belong to the specific application of the process of catalytic hydrotreatment of heavy hydrocarbons described in the present invention and is presented in order to demonstrate that using operating conditions in the range of low pressure, combined with a high Hydrogen/Hydrocarbon $H_2$/HC ratio, in combination with the type of reactor and type of feedstock, high conversions are obtained in the range of 50 to 80%, as is reported in the patents described in the background information, as well as a high formation of sediments and sludge.

For such purposes, the hydrotreatment of a vacuum residue was carried out in a catalytic ebullated-bed reactor. The specific properties of the feedstock are presented in Table 21 and the operating conditions are those of Table 22. The properties of the hydrotreated residue are indicated in Table 23.

As is observed in Table 23, after carrying out the HDT of the vacuum residue in an ebullated-bed reactor, the formation of sediments and sludge is 1.38% by weight. This value of sediments and sludge is higher than the maximum acceptable limit of 0.80% by weight, for maintaining continuity in the operation of this type of processes, and is also higher than those reported in all of the preferred modalities of the present invention.

TABLE 21

Properties of a vacuum residue of a heavy crude

| Properties | ASTM Method | Values |
|---|---|---|
| API Gravity | D-287 | 1.87 |
| Total sulfur, weight % | D-4294 | 5.07 |
| Total nitrogen, wppm | D-4629 | 6,200 |
| Ramsbottom carbon, weight % | D-524 | 25.41 |
| Asphaltenes, weight % | D-3279 | 25.46 |
| Metals, wppm | | |
| Ni + V | | 777.9 |
| Sediments and sludge, weight % | D4870 | 0.0 |
| Fraction IBP-538° C.$^+$, volume % | | 0.0 |

TABLE 22

Operating conditions for the catalytic hydrotreatment of a vacuum residue in an ebullated-bed reactor

| Operating conditions | Ebullated-bed |
|---|---|
| Temperature, ° C. | 400 |
| Pressure, kg/cm$^2$ | 100 |
| LHSV, h$^{-1}$ | 0.25 |
| $H_2$/HC ratio, nl/l | 2,671 |
| Purity of hydrogen, mole % | 100 |

TABLE 23

Properties and composition of the hydrotreated residue

| Properties | ASTM Method | Hydrotreated residue |
|---|---|---|
| API Gravity | D-287 | 21.19 |
| Total sulfur, weight % | D-4294 | 0.714 |
| Total nitrogen, wppm | D-4629 | 3,800 |
| Asphaltenes, weight % | D-3279 | 3.67 |

TABLE 23-continued

Properties and composition of the hydrotreated residue

| Properties | ASTM Method | Hydrotreated residue |
|---|---|---|
| Metals, wppm | | |
| Ni + V | | 47 |
| Sediments and sludge, weight % | D-8470 | 1.38 |
| Conversion, volume % | | 75.2 |
| Composition, volume % | | |
| Fraction IBP-170° C. | | 6.5 |
| Fraction 170–360° C. | | 36.4 |
| Fraction 360–538° C. | | 32.3 |
| Fraction 538° C.+ | | 24.8 |
| Fraction IBP-538° C.+ | | 75.2 |

Example 10

This other example also does not belong to the specific application of the process of catalytic hydrotreatment of heavy hydrocarbons described in the present invention and is also presented in order to demonstrate that using high reaction pressures during the hydrotreatment of a vacuum residue in a catalytic ebullated-bed reactor does not minimize the formation of sediments and sludge. The specific properties of the feedstock are described in Table 24 and the operating conditions are those of Table 25. The properties of the hydrotreated residue are indicated in Table 26.

In Table 26 it is observed that after carrying out the HDT of the vacuum residue in an ebullated-bed reactor, the formation of sediments and sludge present is 1.0% by weight. This value of sediments and sludge is on the upper limit of the acceptable maximum of 0.80% by weight, for maintaining continuity in the operation of this type of processes, and is also higher than those reported in all of the preferred modalities of the present invention.

Therefore, from the foregoing, it is clearly observed that there are substantial differences between the processes described in the state-of-the-art and the process of the present invention, and worthy of note are the results of the content of sediments and sludge in the hydrotreated hydrocarbon which in the state-of-the-art are equal to or above 1% by weight and in those of the examples of the present invention are below 0.65% by weight. In this regard, it should be mentioned that to maintain continuity in the operation of the processes of hydrotreatment of heavy hydrocarbons of petroleum, the formation of sediments and sludge is limited to a maximum content of 0.80% by weight.

TABLE 24

Properties of a vacuum residue

| Properties | ASTM Method | Values |
|---|---|---|
| API Gravity | D-287 | 3.73 |
| Total sulfur, weight % | D-4294 | 4.507 |
| Total nitrogen, wppm | D-4629 | 6,100 |
| Conradson carbon, weight % | D-524 | 22.59 |
| Asphaltenes, weight % | D-3279 | 17.75 |
| Metals, wppm | | |
| Ni + V | | 502.6 |
| Sediments and sludge, weight % | D4870 | 0.0 |
| Fraction IBP-538° C., volume % | | 0.0 |

TABLE 25

| Operating conditions for the catalytic hydrotreatment of a vacuum residue in an ebullated-bed reactor | |
|---|---|
| Operating conditions | Ebullated-bed |
| Temperature, ° C. | 420 |
| Pressure, kg/cm$^2$ | 185 |
| LHSV, h$^{-1}$ | 0.30 |
| $H_2$/HC ratio, nl/l | 1,335 |
| Purity of hydrogen, mole % | 100 |

TABLE 26

| Properties and composition of the hydrotreated residue | | |
|---|---|---|
| Properties | ASTM Method | Hydrotreated residue |
| API Gravity | D-287 | 18.0 |
| Total sulfur, weight % | D-4294 | 2.12 |
| Total nitrogen, wppm | D-4629 | 3,760 |
| Asphaltenes, weight % | D-3279 | 5.58 |
| Metals, wppm | | |
| Ni + V | | 68.4 |
| Sediments and sludge, weight % | D-8470 | 1.0 |
| Conversion, volume % | | 71.9 |
| Composition, % olume % | | |
| Fraction IBP-170° C. | | 12.9 |
| Fraction 170–360° C. | | 26.0 |
| Fraction 360–538° C. | | 33.0 |
| Fraction 538° C.+ | | 28.1 |
| Fraction IBP-538° C.+ | | 71.9 |

Having described the present invention, it is considered as an innovation and therefore, the contents of the following clauses are claimed as property:

1. A two-stage low pressure reaction process for the catalytic hydrotreatment of heavy petroleum hydrocarbons containing a high content of metals, total sulfur, asphaltenes and total nitrogen to improve the properties of the feed hydrocarbons, limit the formation of sediment and sludge, and attain a high removal of contaminants, said process comprising subjecting said heavy petroleum hydrocarbon feedstock to a first reaction stage with hydrogen and a catalyst comprising nickel-molybdenum-titania on gamma alumina and a second reaction stage with hydrogen and a catalyst comprising cobalt-molybdenum-titania on gamma alumina, wherein each of said stages is conducted at a pressure of 40 to 130 kg/cm$^2$, a temperature of 320° to 450° C., a space velocity (LHSV) of 0.2 to 3.0 h$^{-1}$, and a hydrogen/hydrocarbon ratio ($H_2$/HC) of 350 to 1,200 nl/l.

2. The two-stage reaction process of claim 1, wherein hydrodemetallization of hydrocarbons and hydrocracking of asphaltenes is conducted in said first stage.

3. The two-stage reaction process of claim 2, wherein hydrodesulfurization and hydrodenitrogenation of hydrocarbons is conducted in said second stage.

4. The two-stage reaction process of claim 3, wherein the first reaction stage is conducted at a pressure of 45 to 90 kg/cm$^{-2}$, a temperature of 350° to 450° C., a space velocity (LHSV) of 0.2 to 2.0 h$^{-1}$, and a hydrogen/hydrocarbon ratio ($H_2$/HC) of 450 to 1,050 nl/l.

5. The two-stage reaction process of claim 4, wherein the second reaction stage is conducted at a pressure of 45 to 90 kg/cm$^2$, a temperature of 330° to 450° C., a space velocity (LHSV) of 0.2 to 2.0 h$^{-1}$, and a hydrogen/hydrocarbon ratio ($H_2$/HC) of 450 to 1,050 nl/l.

6. The two-stage reaction process of claim 5, wherein said process minimizes the formation of sediment and sludge to a maximum value of 0.65% by weight of the hydrotreated hydrocarbon.

7. The two-stage reaction process of claim 5, wherein said heavy hydrocarbon feed comprises less than 80% by volume of distillates recovered @538° C. and an API gravity below 32°.

8. The two-stage reaction process of claim 7, wherein conversion values of up to 70% by volume of the feed stock are obtained.

9. The two-stage reaction process of claim 5, wherein the properties of the product compared with the feedstock comprise an increase in API gravity up to approximately 15 units and in the content of distillates recovered @538° C. up to approximately 50% by volume, as compared with the feed.

10. The process of claim 1, wherein each said reaction stage is conducted in a fixed-bed reactor or ebullated-bed reactor.

11. The process of claim 10, wherein each of said reaction stages is conducted in a fixed bed reactor.

12. The process of claim 11, wherein said process minimizes the formation of sediment and sludge to a maximum value of 0.8% by weight of the hydrotreated hydrocarbon.

13. The process of claim 12, wherein said process minimizes the formation of sediment and sludge to a maximum value of 0.65% by weight of the hydrotreated hydrocarbon.

14. The process of claim 10, wherein each said reaction stage contains a hydrotreatment catalyst.

15. The process of claim 10, wherein each reaction stage is conducted in an ebullated bed reactor.

16. The two-stage reaction process of claim 1, wherein the amount of sediment and sludge formed in each of said first and second reaction stages is less than 0.65% by weight of the hydrotreated hydrocarbon.

17. The process of claim 1, wherein the weight % titania in the first reaction stage catalyst exceeds the weight % nickel in said first reaction stage catalyst.

18. The process of claim 17, wherein the weight % titania in the second reaction stage catalyst exceeds the weight % cobalt in said second reaction stage catalyst.

19. A two-stage reaction process for the catalytic hydrotreatment of heavy petroleum hydrocarbons containing a high content of metals, total sulfur, asphaltenes and total nitrogen, which process comprises a) passing hydrogen and a heavy petroleum hydrocarbon feedstock having a specific gravity less than 32° API and a content of distillates recovered @538° C. less than 80% by volume to a first reaction stage for hydrotreatment of said feedstock, said first reaction stage comprising a fixed bed or ebullated bed reactor containing a nickel-molybdenum-titania catalyst on a gamma-alumina support and operated to provide a pressure of 40 to 130 kg/cm$^2$, a temperature of 320° to 450° C., a space velocity (LHSV) of 0.2 to 3.0 h$^{-1}$, and a hydrogen/hydrocarbon ratio ($H_2$/HC) of 350 to 1,200 nl/l, so to form a hydrotreated heavy hydrocarbon, b) passing hydrogen and said hydrotreated heavy hydrocarbon to a second reaction stage in a fixed bed or ebullated bed reactor containing a cobalt-molybdenum-titania catalyst on a gamma-alumina support for hydrotreatment at a pressure of 40 to 130 kg/cm$^2$, a temperature of 320° to 450° C., space velocity (LHSV) of 0.2 to 3.0 h$^{-1}$, and a hydrogen/hydrocarbon ratio ($H_2$/HC) of 350 to 1,200 nl/l, wherein the amount of sediment and sludge formed in each of said first and second reaction stages is less than 0.8% by weight of the hydrotreated hydrocarbon.

20. The two-stage reaction process of claim 19, wherein the amount of sediment and sludge formed in each of said first and second reaction stages is less than 0.65% by weight of the hydrotreated hydrocarbon.

21. The process of claim 19, wherein the weight % titania in the first reaction stage catalyst exceeds the weight % nickel in said first reaction stage catalyst.

22. The process of claim 21, wherein the weight % titania in the second reaction stage catalyst exceeds the weight % cobalt said second reaction stage catalyst.

* * * * *

UNITED STATES PATENT AND TRADEMARK OFFICE

CERTIFICATE OF CORRECTION

PATENT NO. : 7,651,604 B2
APPLICATION NO. : 10/563577
DATED : January 26, 2010
INVENTOR(S) : Jorge Ancheyta Juarez et al.

It is certified that error appears in the above-identified patent and that said Letters Patent is hereby corrected as shown below:

On the title page item (75), sixth-named inventor, should read: Fernando Alonso Martinez Signed and Sealed this Twenty-third Day of March, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,651,604 B2
APPLICATION NO. : 10/563577
DATED : January 26, 2010
INVENTOR(S) : Ancheyta Juárez et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 550 days.

Signed and Sealed this

Twenty-third Day of November, 2010

David J. Kappos

David J. Kappos
*Director of the United States Patent and Trademark Office*